US006184913B1

(12) United States Patent
Nagano et al.

(10) Patent No.: US 6,184,913 B1
(45) Date of Patent: Feb. 6, 2001

(54) THERMAL HEAD AND METHOD OF MANUFACTURING THE SAME

(75) Inventors: Katsuto Nagano, Yokohama; Masato Susukida, Chiba; Yoshio Saita, Nakakoma Gun; Jun Hirabayashi, Chiba; Jun Hagiwara, Nakakoma Gun, all of (JP)

(73) Assignee: TDK Corporation, Tokyo (JP)

( * ) Notice: Under 35 U.S.C. 154(b), the term of this patent shall be extended for 0 days.

(21) Appl. No.: 09/120,330

(22) Filed: Jul. 22, 1998

(30) Foreign Application Priority Data

Jul. 23, 1997 (JP) ..... 9-197552

(51) Int. Cl.[7] ..... B41J 2/335
(52) U.S. Cl. ..... 347/203
(58) Field of Search ..... 347/200, 201, 347/203

(56) References Cited

U.S. PATENT DOCUMENTS 5,162,814 * 11/1992 Shirakawa et al. ..... 347/203

FOREIGN PATENT DOCUMENTS 5-64905 3/1993 (JP) .

* cited by examiner

*Primary Examiner*—Huan Tran
(74) *Attorney, Agent, or Firm*—Oliff & Berridge, PLC

(57) ABSTRACT

A thermal head including a protection layer having mutually opposed first and second surfaces, said first surface having a printing surface which is brought into contact with a heat sensitive record medium and is protruded from the remaining portion of the first surface of the protection layer, a heat generating sections including resistors and electrodes connected to the electrodes and provided on said second surface of the protection layer at said protruded printing surface, a heat control section including a heat storage layer and a heat conduction layer and provided on said heat generating section, and a driving IC connected to said electrodes. In order to improve the mechanical strength of the thermal head, a reinforcing layer made of a glass is provided on said first surface of the protection layer except for said printing surface such that a surface of said reinforcing layer is not higher than said first surface of the protection layer at said protruded printing surface.

31 Claims, 9 Drawing Sheets

THERMAL HEAD AND METHOD OF MANUFACTURING THE SAME

BACKGROUND OF THE INVENTION

1. Field of the Invention

This invention relates to a thermal head comprising a protection layer having a printing surface which is brought into contact with a heat sensitive record medium, a heat generating section which includes heat generating resistors and electrodes connected to the heat generating resistors and generates heat transferred to said heat sensitive record medium through said protection layer, and a driving circuit connected to said electrodes for supplying a heating electric power to the electrodes.

The present invention also relates to a method of manufacturing the thermal head of the kind mentioned above.

2. Related Art Statement

The thermal head of the kind described in the preamble has been used in simple and low cost printers using heat sensitive papers and heat transfer papers which do not require a supply of inks. In printers using such a thermal head, a high image quality and high printing speed have been required. For instance, in a heat transfer type color printer or an index printer installed in an automatic mini-laboratory, a thermal head having a very high resolution such as 600 dpi to 1200 dpi has been required.

However. in such a thermal head, an excellent heating up and cooling down property is required in order to raise a temperature of the heat generating section within a very short time and to dissipate heat at a high rate. Such a high speed heating up and cooling down property is particularly required for avoiding undesired blur in an printed image. In order to attain a prompt heating up, it is required that a generated heat does not escape from the heat generating section, and in order to effect the rapid heat dissipation, a generated heat has to be dissipated as soon as possible. For attaining a desired heating up and cooling down property, these two contradictory problems have to be solved simultaneously.

Various requirements for the thermal head may be summarized as follows.

1) small size, light weight, simple structure
2) low price
3) large image size covering A3 size
4) low power consumption
5) high printing speed
6) high density and high resolution
7) uniform image quality without irregular color In order to attain one or more of the above mentioned characteristics, there have been proposed various thermal heads. For instance. in Japanese Patent Kokai Hei 5-64905, there is proposed a known thermal head shown in FIG, 1. In this known thermal head, a printing surface is formed to be flat, and therefore a space is hardly formed between the printing surface and a heat sensitive record medium and a thermal efficiency is improved. As shown in FIG. 1, on a flat surface of a preliminary substrate 30, a pealing-off layer 31, a wear and abrasion resistance layer 32, a protection layer 33, a heat generating resistance layer 34, an electrode layer 35 and a heat storage layer 36 made of polyimide resin are successively applied. After cementing the assembly to a substrate 38 by means of an adhesive layer 37, the preliminary substrate 30 is removed by means of the pealing-off layer 31. In this manner, a flat printing surface 40 can be obtained.

However, in the known thermal head illustrated in FIG. 1, in which the heat storage layer 36 is made of a resin material such as polyimide resin and the printing surface 40 constituted by a portion of the wear and abrasion resistance layer 32 is formed to be flat, has the following problem.

A record paper is urged against the thermal head with a very strong force by means of a press roller, but since the printing surface is flat, the roller is brought into contact with the thermal head over a larger area and thus the pressing force is decreased. This results in that an influence of the roller deformation and abrasion might occur.

In order to mitigate the above problem, the inventors have proposed a thermal head, in which a printing surface is curved outwardly or is protruded from one surface of a protection layer and a driving IC is provided on the other surface of the protection layer. However. a thickness of assembly besides the protruded printing surface becomes small, and therefore a mechanical strength is decreased and a reliability of the thermal head is reduced.

SUMMARY OF THE INVENTION

The present invention has for its object to provide a novel and useful thermal head having a large mechanical and a high reliability.

According to the invention, a thermal head comprises:

a protection layer having mutually opposed first and second surfaces. said first surface including a printing surface which is brought into contact with a heat sensitive record medium and is protruded from the remaining portion of the first surface of the protection layer;

a heat generating section provided on said second surface of the protection layer at said protruded printing surface and including heat generating resistors and electrodes connected to the heat generating resistors for generating heat to be transferred to said heat sensitive record medium through said printing surface of the protection layer;

a driving circuit connected to said electrodes of the heat generating section for supplying a heating electric power to the electrodes; and a reinforcing layer made of a material different from a material of said protection layer and provided on said first surface of the protection layer except for said printing surface such that a surface of said reinforcing layer is not higher than said first surface of the protection layer at said protruded printing surface.

In a preferable embodiment of the thermal head according to the invention, said protection layer has a groove formed in the second surface at a portion corresponding to said protruded printing surface, and said heat generating section is provided in said groove.

According to the invention, said thermal head further comprises a heat control section for controlling the heat generated by said heat generating section, said heat control section being provided in said groove such that the heat control section is brought into contact with a side of said heat generating section remote from said protection layer.

In a preferable embodiment of the thermal head according to the invention, said heat control section comprises a heat storage layer, which may be made of a glass having a low melting point or a heat resistant synthetic resin such as epoxy resin and polyimide resin. In case of using the heat resistant synthetic resin, ceramic fillers or powders such as alumina and silica and/or metal powders may be added for adjusting a thermal conductance and thermal expansion of the heat storage layer.

In a preferable embodiment of the thermal head according to the invention, said heat control section further comprises a heat conduction member for dissipating a heat stored in the heat storage layer. By suitably constructing said heat storage layer and heat conduction member, the heat control can be performed optimally.

According to the invention, said heat conduction member may be made of a metal or an alumina based ceramic coating agent. In case of forming the metal heat conduction member, a metal rod may be advantageously used.

According to the invention, an assembly of the protection layer, heat generating section, heat control section and driving IC may be supported by a supporting member. This supporting member may be formed by a heat resistant synthetic resin or a metal plate. In case of using the heat resistant synthetic resin, the driving IC may be embedded in the supporting member, and in case of using a metal substrate plate, the driving IC may be provided in a recess formed in the metal substrate plate. According to the invention, it is also possible to provide said driving IC in a recess formed in the second surface of the reinforcing layer.

According to the invention, said reinforcing layer is preferably made of a glass such as borosilicate glass. Further, said protection layer is preferably made of a material selected from the group consisting of SiC compounds, SiB compounds, SiN compounds, AIN compounds and BN compounds.

According to the invention, a method of manufacturing a thermal head comprises the steps of:

forming a groove in a surface of a preliminary substrate;

forming a protection layer on an inner surface of said groove as well as on said surface of the preliminary substrate, a portion of said protection layer provided on the inner surface of the groove constituting a printing surface and said protection layer being made of a material different from said preliminary substrate;

forming a heat generating section on said protection layer at least at said groove, said heat generating section including heat generating resistors and electrodes connected to the resistors;

forming a heat control section at least on said heat generating section, said heat control section including at least a heat storage layer; and forming a reinforcing layer by removing a part of said preliminary substrate such that at least a part of said printing surface of the protection layer is exposed.

In a preferable embodiment of the method according to the invention. said step of forming the reinforcing layer includes a step of covering an assembly with an anti-etching layer, and a step of etching a part of the preliminary substrate.

In another preferable embodiment of the method according to the invention, said step of forming the reinforcing layer includes a step of covering the assembly with an anti-etching layer, a step of mechanically polishing said preliminary substrate to such a level that said printing surface is still covered with a thin film of a material of said preliminary substrate, and a step of wet-etching the preliminary substrate until said printing surface is exposed.

In another preferable embodiment of the method according to the invention, said step of forming the reinforcing layer includes a step of covering the assembly with an anti-etching layer, a step of mechanically polishing said preliminary substrate to such a level that said printing surface is still covered with a thin film of a material of said preliminary substrate, and a step of chemical-mechanical-polishing the preliminary substrate until said printing surface is exposed.

Further, a heat sink made of a metal such as aluminum and copper may be provided in the substrate in order to improve the heat dissipation property.

Furthermore, in order to reduce a size of the thermal head, it is preferable that an IC constituting said driving circuit is arranged on a second surface of the protection layer, said second surface being opposite to said first surface. In this case, the IC may be embedded in a supporting member made of a resin or may be provided in a recess formed in the second surface of the reinforcing layer or may be provided in a recess formed in the substrate.

According to the invention, said protection layer is preferably made of a material selected from the group consisting of SiC compounds, SiB compounds, SiN compounds, AIN compounds and BN compounds. In this case, it is preferable that said reinforcing layer is made of a glass such as borosilicate glass. It is another object of the present invention to provided a novel and useful method of manufacturing a thermal head.

According to the invention, a method of manufacturing a thermal head comprises the steps of:

forming a groove in a surface of a preliminary substrate;

forming a protection layer on an inner surface of said groove as well as on said surface of the preliminary substrate, a portion of said protection layer provided on the inner surface of the groove constituting a printing surface;

forming a heat generating section on said protection layer at said groove, said heat generating section including heat generating resistors and electrodes connected to the resistors;

forming a heat controlling section at 0 least on said heat generating section; and forming a reinforcing layer by reducing a thickness of said preliminary substrate such that at least a part of said printing surface of the protection layer is exposed.

According to the invention, it is preferable to conduct said step of forming the reinforcing layer by mechanically polishing said preliminary substrate and by wet-etching or chemical-mechanical-polishing the preliminary substrate.

DESCRIPTION OF THE PREFERRED EMBODIMENT

Figure 1:
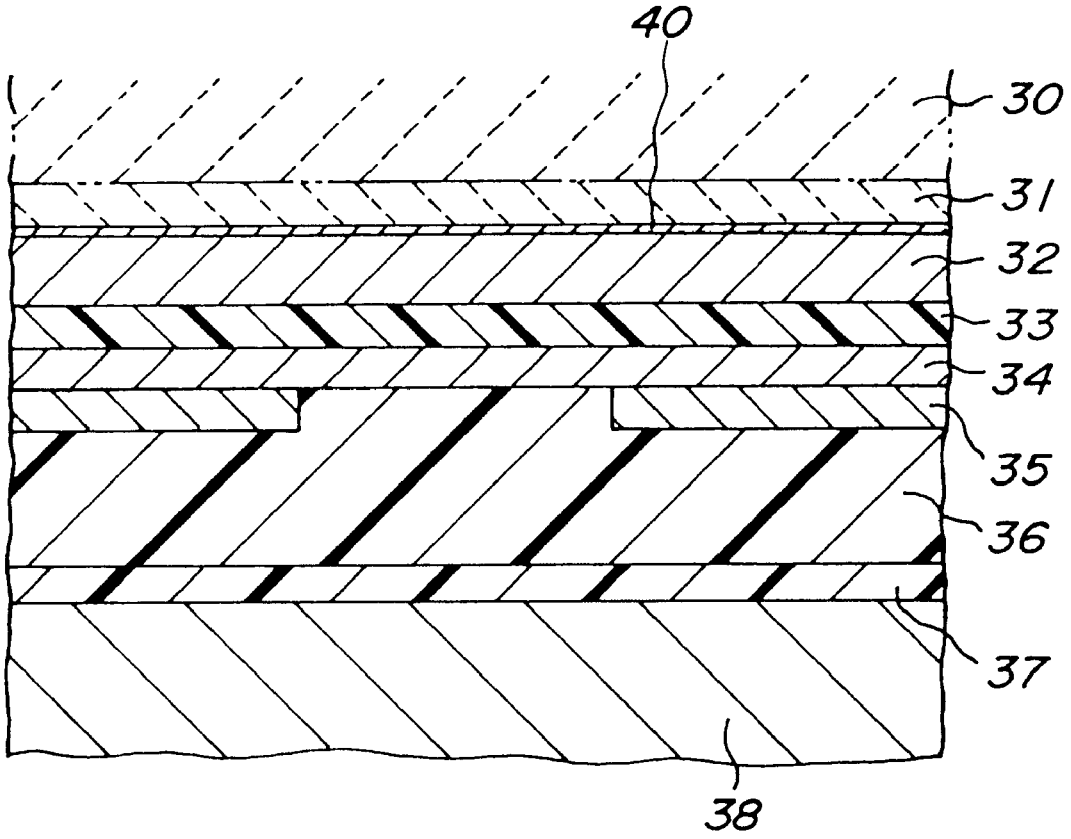
FIG 1 PRIOR ART
FIG. 1 is a cross sectional view showing a known thermal head.
Figure 2:
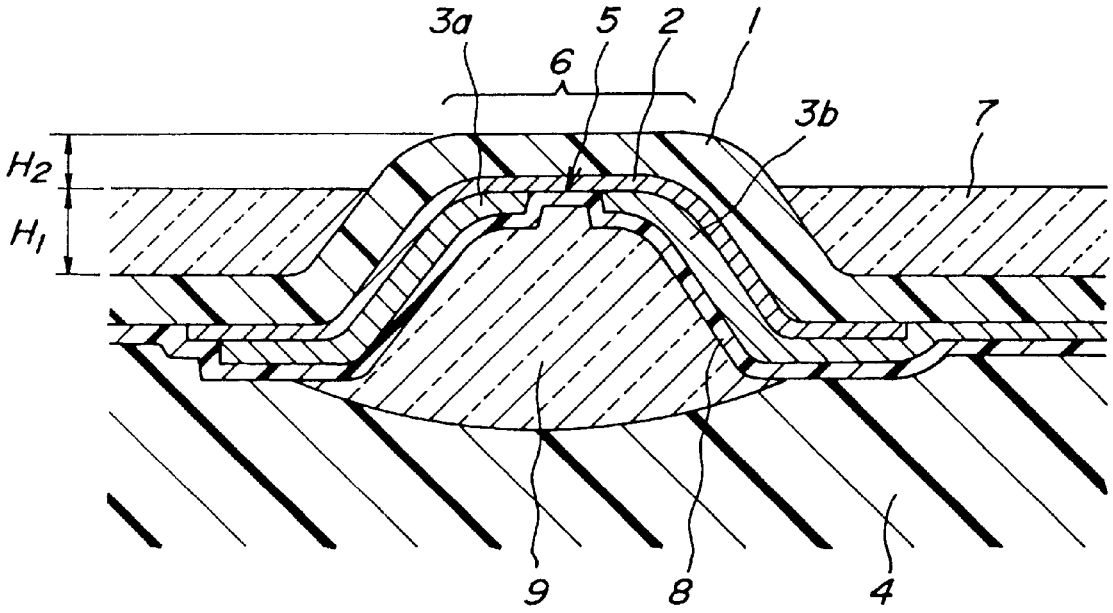
FIG. 2 is a cross sectional view illustrating a first embodiment of the thermal head according to the invention.

FIG. 2 is a cross sectional view showing a first embodiment of the thermal head according to the invention. The thermal head comprises a protection layer 1, heat generating resistors 2, a common electrode 3*a* connected commonly to one ends of all the resistors 2, separate electrodes 3*b* each being connected to the other ends of respective resistors 2, a barrier layer 8, a heat storage layer 9, a supporting member 4 and a reinforcing layer 7. It should be noted that a number of the heat generating resistors 2 and a number of the separate electrodes 3*b* are aligned in a direction perpendicular to the plane of the drawing of FIG. 2. The heat generating resistors and electrodes 3*a*, 3*b* constitute a heat generating section 5. A heat generated by the heat generating section 5 is transferred to a heat sensitive record medium by means of a printing surface 6 of the protection layer 1. As shown in FIG. 2. the printing surface 6 of the protection layer 1 is protruded outwardly, and the heat generating section 5 is formed within this protruded portion. According to the invention, the reinforcing layer 7 is provided such that at least a part of the printing surface 6 is exposed.

The protection layer 1 may be made of a material selected from the group consisting of SiC compounds, SiB compounds, SiN compounds, AIN compounds and BN compounds. Particularly, it is preferable to form the protection layer 1 by a first layer which is brought into contact with the heat sensitive record medium and is made of a hard and chemically stable material having a low coefficient of friction such as SiB and a second layer made of a material having a highly electrically insulating material such as $SiO_2$, The protection layer 1 may be formed by any known method such as plasma CVD.

The heat generating resistors 2 may be made of a material selected from the group consisting of Nb—$SiO_2$, Ni—Cr, Ta, $TiO_2$ and BN. The heat generating resistors 2 may be formed by LP (low pressure) CVD, plasma CVD or sputtering. After depositing a film of an electrically resistive material, the film is selectively etched to form the heat generating resistors 2 having a desired pattern. The etching may be preferably effected by a dry-etching such as RIE (reactive ion etching), but a wet-etching may be also utilized. In case of the dry-etching, $SF_6$, $CF_4$, $Cl_2$, $O_2$ and a mixture thereof may be used as a reactive gas.

The electrodes 3*a*, 3*b* may be made of a metal selected from the group consisting of Al, Cu, Au, Ta, W and Mo. It should be noted that a multi-layer of these metals may be also used as the electrodes 3*a*, 3*b*. According to the invention, the electrodes 3*a*, 3*b* are preferably made of aluminum, because aluminum is cheap, can be adhered to another layer without interposing an additional layer therebetween, has a low electric resistance, and can be easily formed into a desired fine pattern. The electrodes 3*a*, 3*b* may be formed by any conventional method such as evaporation and sputtering.

The patterning for obtaining the electrodes 3*a*, 3*b* is preferably formed by the wet-etching, although the dry-etching may be utilized. In case of the wet-etching, $H_2SO_4$, $HNO_3$ and a mixture of $H_3PO_4$, $C_2H_4O_2$ and $HNO_3$ may be used as an etchant.

The barrier layer 8 is provided for preventing undesired outdiffusion of a material of the supporting member 4, and may be made of $SiO_2$ or SiN. The barrier layer 8 may be formed by LP CVD, plasma CVD or sputtering. Patterning for forming the barrier layer 8 may be carried out by both the dry-etching and wet-etching. In case of the wet-etching, HF or a mixture of HF and $NH_4F$ may be used as an etchant.

The heat storage layer 9 is preferably made of a glass having a low melting point. When the heat storage layer 9 is made of a glass having a melting point not higher than 450° C., particularly 400° C., the electrodes 3*a*, 3*b* made of aluminum can be effectively prevented from being oxidized or altered. When the heat storage layer 9 is made of a glass having a melting point not higher than 300° C., particularly 350° C., the storage layer might be deformed by a heating process to be conducted after the formation of the heat storage layer. Therefore, it is preferable to make the heat storage layer 9 of glass having a melting point from 300–450° C., particularly 350–400° C.

The heat storage layer 9 made of a low melting point glass may be formed by screen printing or by using a dispenser, and a sintering is carried out at 350–400° C. The heat storage layer 9 is preferably made of a lead glass of PbO—$B_2O_3$ or PbO—$B_2O_3$—ZnO.

The supporting member 4 may be made of a synthetic resin such as polyimide resin and epoxy resin. Mechanical strength and thermal conductance of the supporting member 4 may be adjusted by adding ceramic fillers or powders such as alumina and silica and/or metal powders.

It should be noted that the supporting member 4 may constitute a substrate of the thermal head. Then, a conventional substrate such as a ceramic substrate and glaze substrate may be dispensed with, and therefore a cost of the thermal head according to the invention can be reduced. If desired, the supporting member 4 may be cemented to a metal substrate plate serving as a heat sink. The metal substrate plate may be made of aluminum or copper, In the first embodiment illustrated in FIG. 2, a thickness $H_1$ of the reinforcing layer 7 is smaller than a height of the printing surface 6. A thickness $H_1$ of the reinforcing layer 7 is preferably set to a value within a range from 200 $\mu$m to 500 $\mu$m for attaining an effective improvement in the mechanical strength, and a distance $H_2$ from a top surface of the reinforcing layer 7 to the protruded printing surface 6 is preferably set to a value within a range from 10 $\mu$m to 100 $\mu$m, particularly 20 $\mu$m to 50 $\mu$m for attaining a high definition of image.

Figure 3:
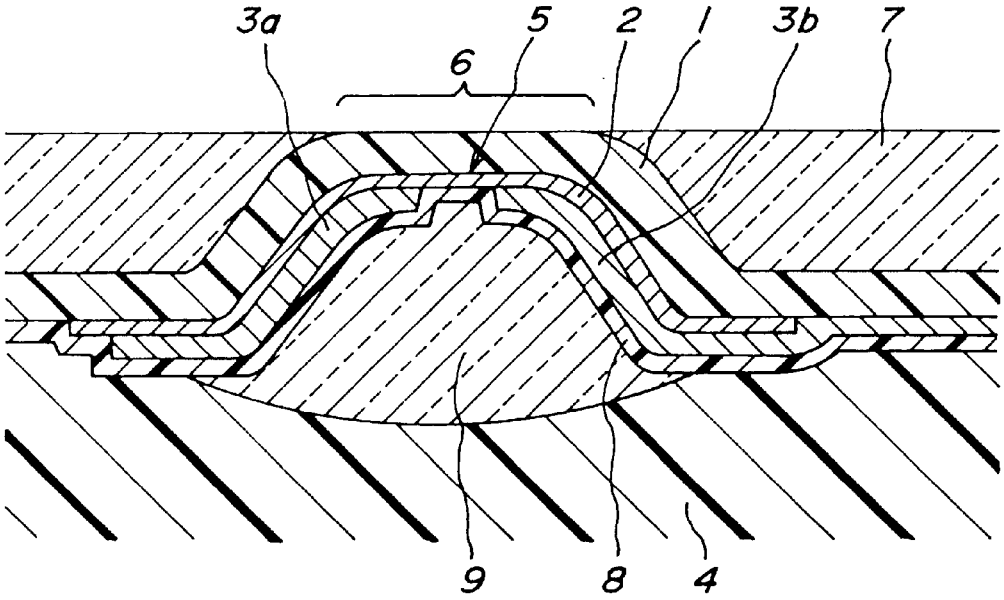
FIG. 3 is a cross sectional view depicting a second embodiment of the thermal head according to the invention.

FIG. 3 is a cross sectional view showing a second embodiment of the thermal head according to the invention. In this embodiment, the reinforcing layer 7 has a thickness which is substantially equal to a height of the protruded printing surface 6. That is to say, the printing surface 6 is co-planer with the surface of the reinforcing layer 7. Therefore, in this embodiment, the reinforcing faculty of the reinforcing layer 7 becomes larger. However, since the printing surface 6 is not protruded from the surface of the reinforcing layer 7, the pressure roller could not press the heat sensitive record medium against the printing surface with a large force.

Figure 4A:
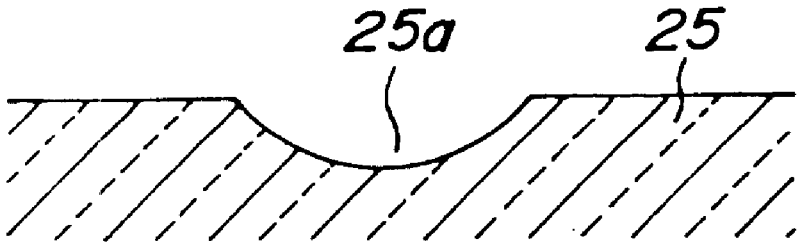
FIGS. 4A–4H arc cross sectional views showing successive steps of the method of manufacturing the thermal head shown in FIG. 2.

FIGS. 4A to 4H are cross sectional views showing successive steps for manufacturing the thermal head illustrated in FIG. 2. At first, as shown in FIG. 4A, a groove 25*a* is formed in a surface of a preliminary substrate 25. The preliminary substrate 25 is made of a borosilicate glass which could be easily obtained at a low cost. In the present embodiment, the preliminary substrate 25 is formed by a BLC (trade name) borosilicate glass plate having a thickness of 0.7 mm manufactured by Nippon Denki Glass Company. It should be noted that the preliminary substrate 25 will constitute the reinforcing layer 7. The groove 25*a* is formed by a wet-etching to have a width of 700 $\mu$m and a depth of 300 $\mu$m. The groove 25*a* is formed to have a cross sectional configuration of arc, but it may have a trough shape having a flat bottom surface.

Figure 4B:
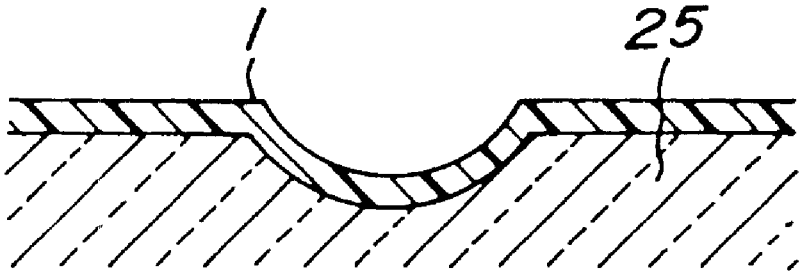

Next, as illustrated in FIG. 4B, a protection layer 1 is formed on the surface of the preliminary substrate 25 as well as on an inner wall of the groove 25*a*. The protection layer 1 is formed by successively depositing a SiB layer having a thickness of 7 μm and a $SiO_2$ layer having a thickness of 3 μm by the plasma CVD at a temperature of 400° C.

Figure 4C:
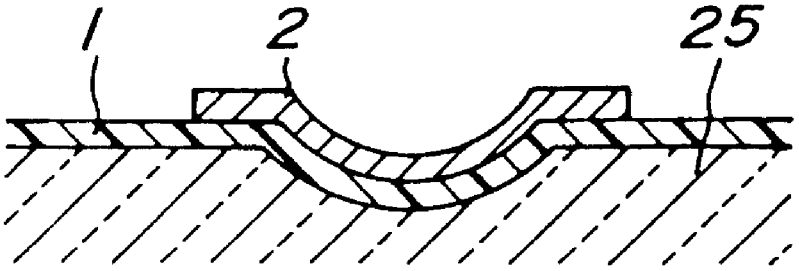

After forming the protection layer 1, a Nb—$SiO_2$ layer having a thickness of 0.1 μm is deposited on the protection layer by sputtering at a temperature of 300–350° C., and then a patterning process for the Nb—$SiO_2$ layer is carried out by RIE to form an array of heat generating resistors 2 as depicted in FIG. 4C The heat generating resistors 2 are arranged with a pitch of 167 μm and an edge distance of 10 μm. The Nb-$SiO_2$ layer means an amorphous $SiO_2$ layer having metal Nb, silicide of Nb and oxide of Nb contained therein. After forming the heat generating resistors 2, a thermal treatment may be carried out at about 400° C. for improving TCR of the heat generating section 5.

Figure 4D:
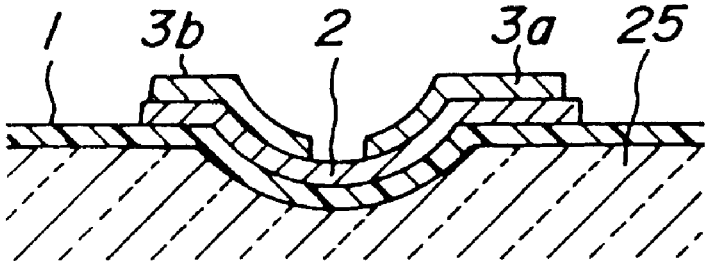

Next, an Al layer having a thickness of 0.5 μm is deposited by the evaporation at 100° C., and then the deposited Al layer is etched by using an etchant formed by a mixture of $H_3PO_4$, $C_2H_4O_2$ and $HNO_3$ to form a common electrode 3a and separate electrodes 3*b* as illustrated in FIG. 4D. The common electrode 3*a* is connected commonly to one ends of the heat generating resistors 2 and the separate electrodes 3*b* are connected to the other ends of respective heat generating resistors 2.

Figure 4E:
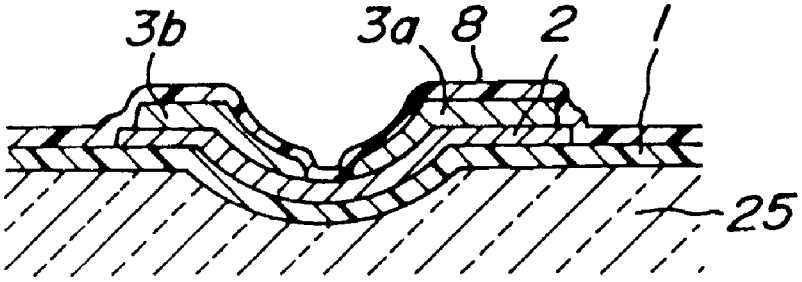

Then, a $SiO_2$ layer having a thickness of 0.3 μm is deposited by the plasma CVD, and then is etched by using HF etchant to form a barrier layer 8 as illustrated in FIG. 4E.

Figure 4F:
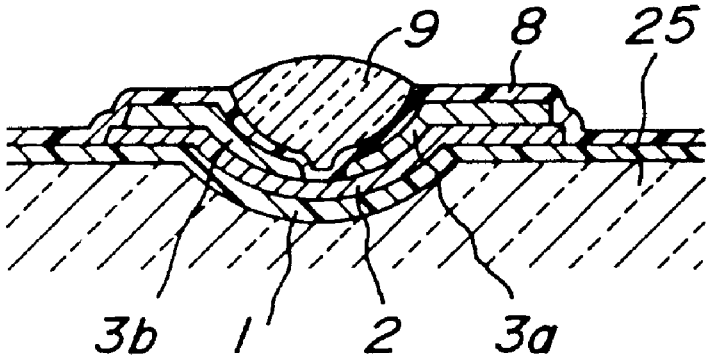

Next, as shown in FIG. 4F, a heat storage layer 9 is provided by printing a glass paste to have a width substantially equal to or slightly larger than a width of a groove formed on the back of the heat generating section. The glass paste may be applied by using a dispenser. After that, the assembly is heated at 350–400° C. to sinter the glass paste to form the heat storage layer 9.

Figure 4G:
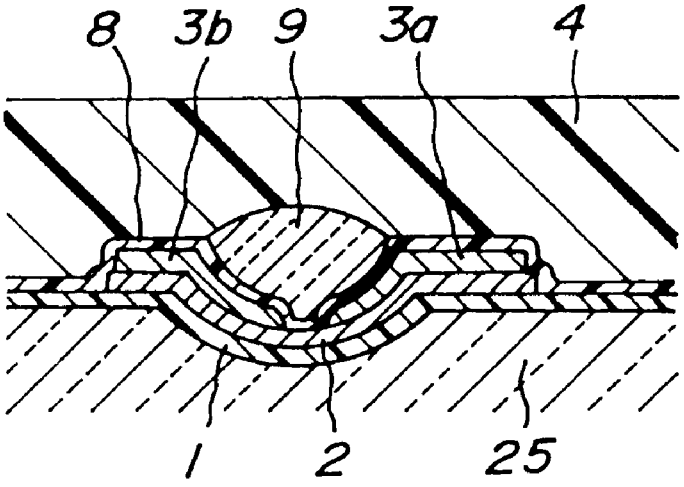

Next, as depicted in FIG. 4G, a supporting member 4 is formed by applying a paste including polyimide resin and by heating the assembly at 350° C. for two hours to harden the paste.

Figure 4H:
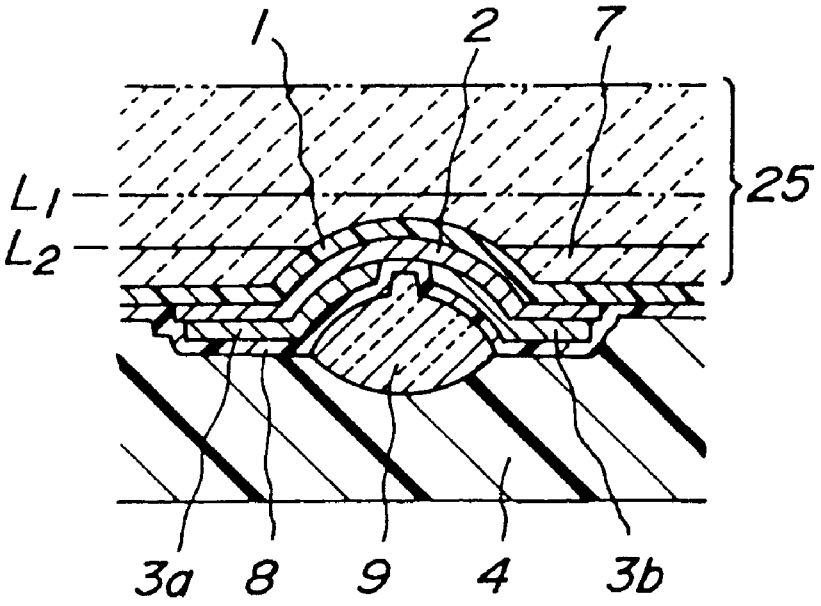

After the assembly is covered with an anti-etching film except for the surface of the preliminary substrate 25, the assembly is immersed into a HF liquid to resolve the preliminary substrate 25 partially to form a reinforcing layer 7 as shown in FIG. 4H. It should be noted that the drawing of FIG. 4H is turned up side down with respect to FIGS. 4A–4G.

The partial removal of the preliminary substrate 25 to form the reinforcing layer 7 can be performed efficiently in the following manner. At first, a part of the preliminary substrate 25 is removed by a mechanical polishing from its upper surface to a level $L_1$ which is slightly higher than a level of the protruded surface of the protection layer 1. Then, an assembly is covered with an anti-etching layer except for the surface of the preliminary substrate 25, and a part of the preliminary substrate is removed up to a level $L_2$ by the wet-etching using, for instance HF etchant or by the chemical-mechanical polishing (CMP) or by a combination of these wet etching and CMP. In CMP, abrasion particles such as silica particles are contained in an etchant and the etchant is flowed with respect to the surface of the preliminary substrate 25.

Figure 5:
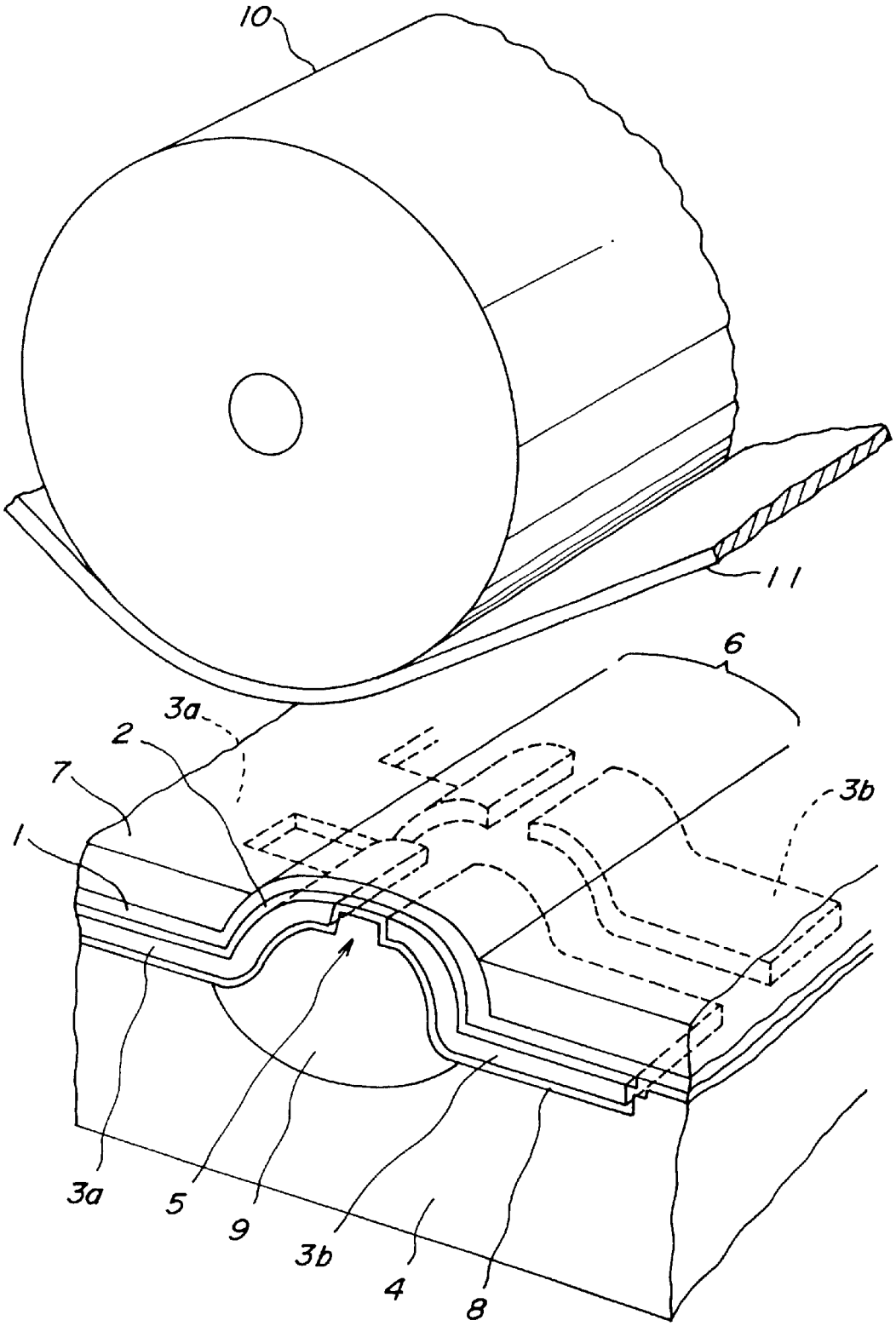
FIG. 5 is a perspective view depicting the thermal head shown in FIG. 2 together with press roller and heat sensitive record paper.

FIG. 5 is a perspective view showing the thermal head illustrated in FIG. 2 together with a pressure roller 10 and a heat sensitive record paper 11. Since the printing surface 6 of the thermal head is protruded outwardly, the record paper 11 can be pressed against the printing surface by the press roller 10 with a very large force. In this case, the reinforcing layer 7 is provided on both sides of the heat generating section 5 including the printing surface 6, the heat generating section could hardly be deformed or damaged. In this manner, by means of the thermal head according to the invention, it is possible to obtain a fine very print.

Furthermore, in the present embodiment, since the heat storage layer 9 made of a low melting point glass is provided under the heat generating section 5, a mechanical strength of the heat generating section can be increased. Therefore, if hard particles such as sands are introduced between the printing surface 6 and the record paper 11, the heat generating section 5 can be effectively prevented from being damaged. Moreover, even if a temperature of the heat generating section 5 becomes too high and the supporting member 4 made of a resin is softened, the thermal head can be held by the heat storage layer 9 made of a low melting point glass.

As stated above, according to this embodiment, the printing surface 6 is protruded outwardly, and thus the record paper 11 is urged against the printing surface with a very large force. Therefore, a mechanism for producing a pressing force by the pressure roller 10 can be simplified. Moreover, since the heat generating section 5 serves as rib, a mechanical strength of the thermal head is increased and a bending of the thermal head can be effectively reduced.

Figure 6:
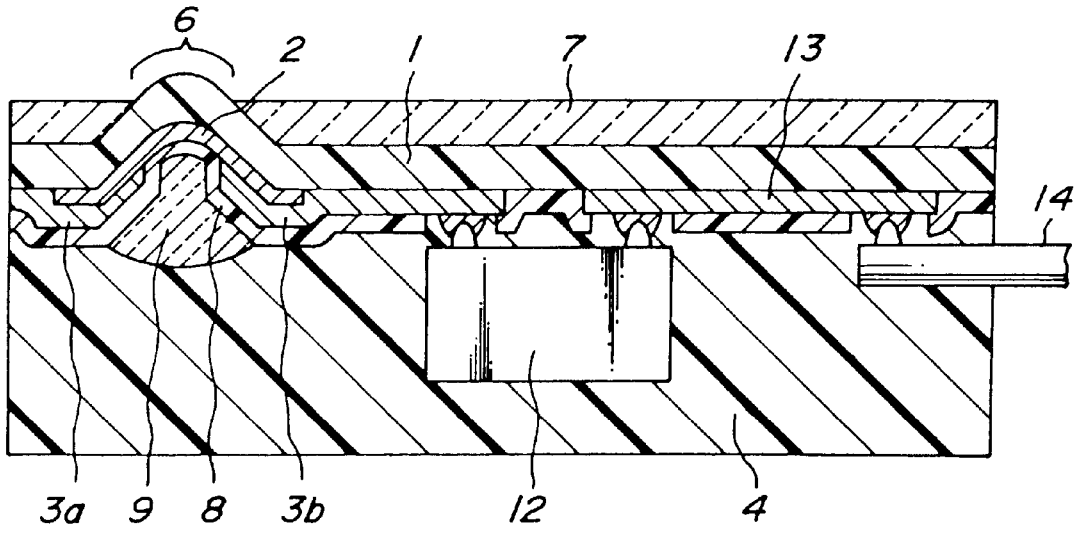
FIG. 6 is a cross sectional view showing a third embodiment of the thermal head according to the invention.

FIG. 6 is a cross sectional view showing a third embodiment of the thermal head according to the invention. In the present embodiment, a driving circuit for supplying an electric power to the heat generating resistors 2 is constituted by an IC 12, which is connected to the separate electrodes 3*b* and connecting electrodes 13 by flip tip bonding. The IC 12 is embedded in the supporting member 4 made of a synthetic resin. To the connecting electrodes 13 are connected conductors 14 for connecting the IC to an external circuit not shown. As shown in FIG. 6, the IC 12 is provided on a side of the protection layer 1 which is opposite to a side facing the recording medium.

In this manner, the IC 12 is provided on the opposite side to the printing surface 6, the record medium could never be brought into contact with the IC, and therefore a distance between the printing surface 6 and the IC 12 can be shortened as compared with the known thermal head in which the IC is arranged on the same side of the protection layer as the printing surface. In this manner, the thermal head can be miniaturized. Further-more, since the record medium is not brought into contact with the IC 12 as well as the connecting electrodes 13 for connecting the IC to the external circuit, undesired cut-off and short-circuit can be effectively prevented.

In the embodiment shown in FIG, 6, the supporting member 4 made of a synthetic resin also serves to hold the IC 12 in position. and therefore it is possible to reduce the number of parts and process steps. In this manner, the cheap thermal head can be obtained. Moreover, according to the invention, since the reinforcing layer 7 is provided on the protection layer 1 above the separate electrodes 3*b* and connecting electrodes 13 connected to the IC 12, these electrodes can be effectively protected from being cut-off although the thermal head is deformed. In this manner, a reliability of the thermal head is improved.

Further, since a size of the thermal head is reduced, a number of thermal heads manufactured from a single preliminary substrate can be increased. Therefore, the thermal heads can be manufactured efficiently at a low cost.

Figure 7:
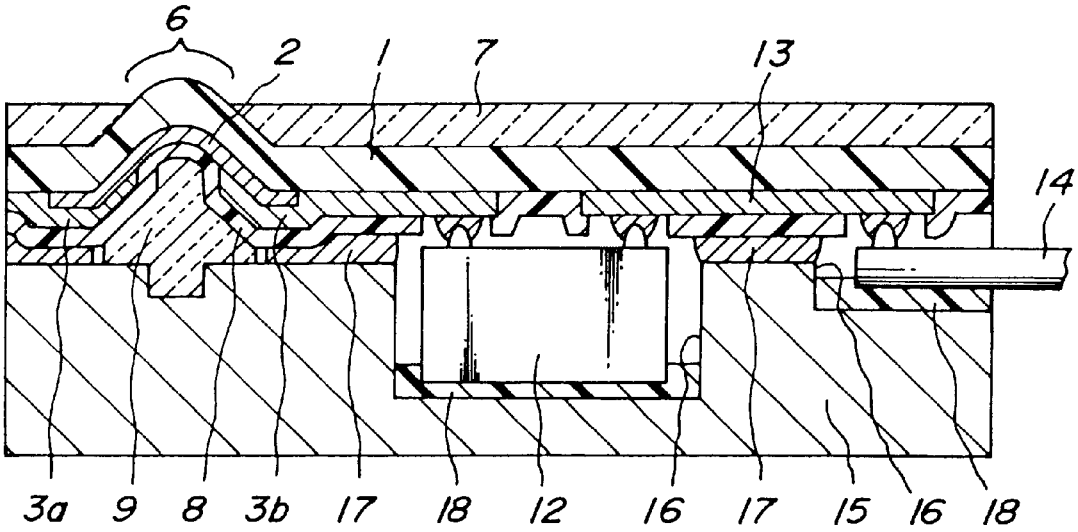
FIG. 7 is a cross sectional view illustrating a fourth embodiment of the thermal head according to the invention.

FIG. 7 is a cross sectional view illustrating a fourth embodiment of the thermal head according to the invention. A substrate 15 is made of aluminum and depressions 16 are formed in a surface of the substrate by, for instance extrusion. After connecting the IC 12 and conductors 14 to the electrodes 3*b* and 13 by, for instance soldering, an assembly is secured to the substrate 15 by means of adhesive tapes or cementing agents 17 such that the IC 12 and conductors 14 are inserted into the depressions 16 and the IC 12 and conductors 14 are secured to bottoms of the depressions 16 by means of cementing agents 18.

In the present embodiment, since the depressions 16 can be formed easily by the extrusion, a cost of the thermal head can be deceased. Moreover, the aluminum substrate 15 can be also used as a heat sink. The IC 12 and conductors 14 are secured to the substrate 15 by means of the adhesive agents 18 a heat generated by the IC can be effectively dissipated through the substrate 15.

Figure 8:
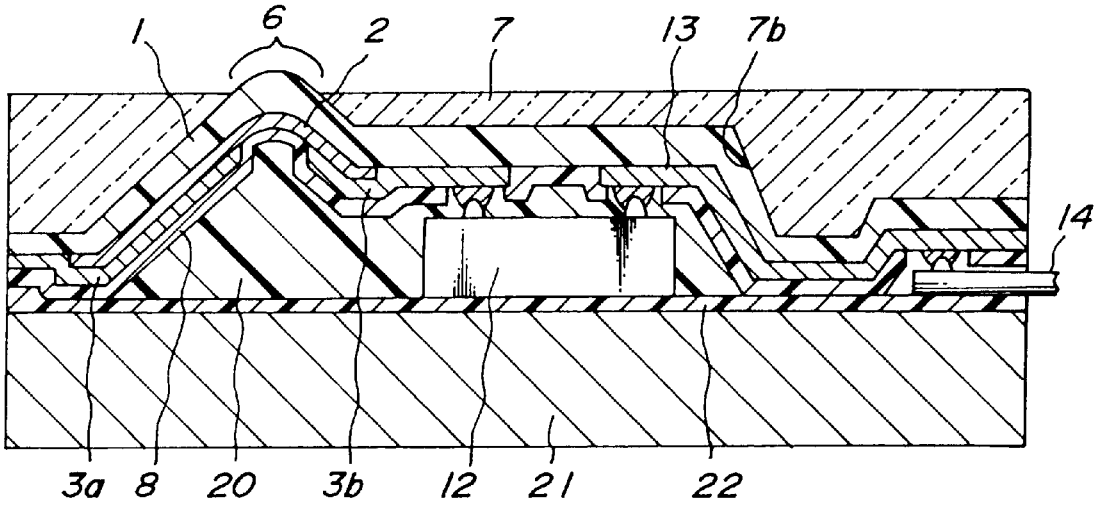
FIG. 8 is a cross sectional view depicting a fifth embodiment of the thermal head according to the invention.

FIG. 8 is a cross sectional view depicting a fifth embodiment of the thermal head according to the invention. In the present embodiment, in the surface of the preliminary substrate constituting the reinforcing layer 7, there are formed depressions 7*b* and 7*c* for accommodating IC 12 and conductors 14. After forming the protection layer 1, heat generating resistors 2, electrodes 3*a* and 3*b*, barrier layer 8 and connecting electrodes 13, the IC 12 and conductors 14 are secured to the electrodes. Then, the IC 12 and conductors 14 are molded with an adhesive layer 20 made of epoxy resin. and an assembly is secured to an aluminum or alumina substrate 21 by means of an adhesive layer 22.

In the embodiment shown in FIG. 8, since the preliminary substrate constituting the reinforcing layer 7 is made of a glass plate, in which the groove and depressions can be easily formed by cutting, the thermal head can be easily manufactured on a large scale at a lower cost. In the present embodiment, a portion of the adhesive layer 20 situating below the heat generating section also serves as the heat storage layer. According to the invention, a separate heat storage layer made of a low melting point glass may be provided under the heat generating section.

Figure 9:
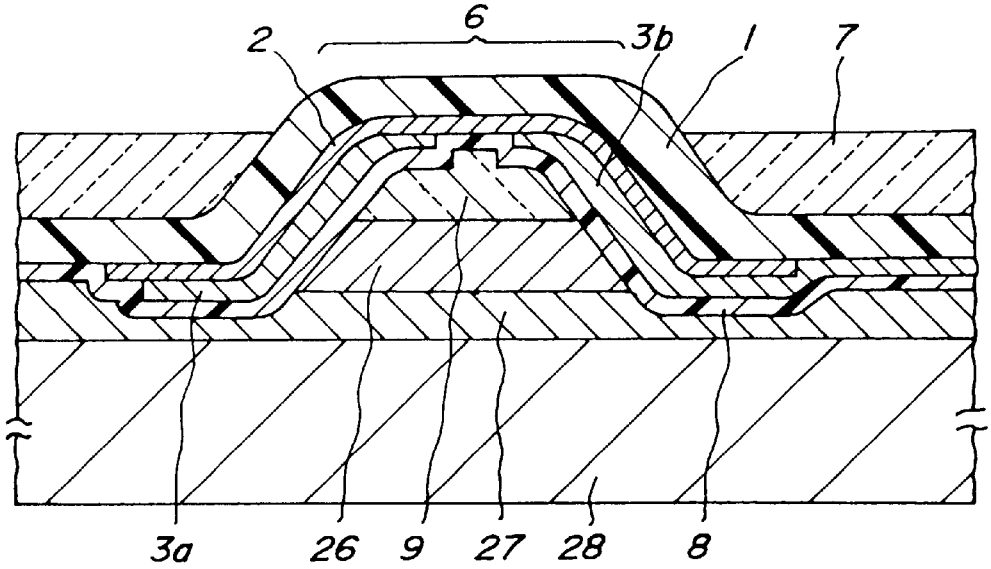
FIG. 9 is a cross sectional view showing a sixth embodiment of the thermal head according to the invention.

FIG. 9 is a cross sectional view showing a sixth embodiment of the thermal head according to the invention. In the present embodiment, below the heat generating section 5, there are provided a heat storage layer 9 and a heat conduction layer 26, and an assembly is secured to a substrate 28 serving as a heat sink by means of an adhesive layer 27. The heat storage layer 9 is made of a glass having a low melting point, but it may be made of a heat resistant synthetic resin such as polyimide and epoxy. In order to adjust a thermal conductance and thermal expansion of the heat storage layer, ceramic fillers such as alumina fillers and silica fillers or metal powders may be added to the low melting point glass. The heat conduction layer 26 may be made of an alumina based ceramic coating agent. The adhesive layer 27 may be made of a silicone resin containing alumina fillers.

Figure 10:
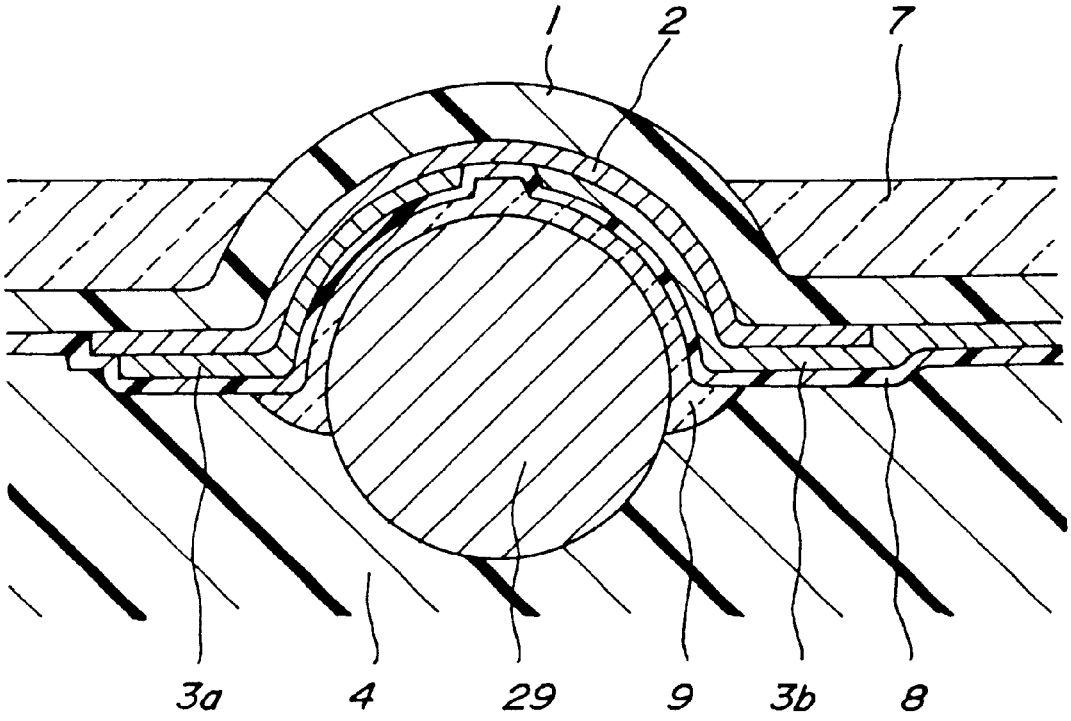
FIG. 10 is a cross sectional view illustrating a seventh embodiment of the thermal head according to the invention.

FIG. 10 is a cross sectional view illustrating a seventh embodiment of the thermal head according to the invention. In the present embodiment, a heat conduction member is formed by a metal rod 29. The metal rod 29 may be made of aluminum or copper. The metal rod 29 is secured to the barrier layer 8 by means of the heat storage layer 9 made of a heat resistant synthetic resin such as epoxy resin and silicone resin.

The present invention is not limited to the embodiments explained above, but many alternations and modifications may be conceived by those skilled in the art within the scope of the invention. For instance, in the above embodiments, after forming the heat generating resistors 2, the electrodes 3*a* and 3*b* connected to the resistors are formed. However, according to the invention, the electrodes 3*a* and 3*b* may be formed prior to the formation of the heat generating resistors 2.

Furthermore, in the embodiment shown in FIG. 9, the heat conduction member is formed by the alumina based ceramic coating agent and in the embodiment illustrated in FIG. 10, the heat conduction member is formed by the metal rod 29, but according to the invention the heat conduction member may be formed by depositing a gold thin film on the heat storage layer, applying a cream solder on the gold film, and then by curing the cream solder in a re-flow furnace. Alternatively, the heat conduction member may be formed depositing a thin film of gold, copper or nickel on and near the heat storage layer, and depositing a film of copper or nickel by an electroplating.

What is claimed is:

1. A thermal head comprising:

a protection layer having mutually opposed first and second surfaces, said first and second surface being protruded toward a printing surface which is brought into contact with a heat sensitive record medium and is protruded from the remaining portion of the first surface of the protection layer and a part of said second surface being also protruded toward the printing surface according to the first surface;

a heat generating section provided on said second surface of the protection layer at said protruded portion and including heat generating resistors and electrodes connected to the heat generating resistors for generating heat to be transferred to said heat sensitive record medium through said printing surface of the protection layer;

a driving circuit connected to said electrodes of the heat generating section for supplying a heating electric power to the electrodes; and a reinforcing layer made of a material different from a material of said protection layer and provided on said first surface of the protection layer except for said printing surface such that a surface of said reinforcing layer is not higher than said first surface of the protection layer at said protruded printing surface.

2. A thermal head according to claim 1, wherein said thermal head further comprises a heat control section for controlling the heat generated by said heat generating section, said heat control section being provided in said groove such that the heat control section is brought into contact with a side of said heat generating section remote from said protection layer.

3. A thermal head according to claim 2, wherein said heat control section comprises a heat storage layer.

4. A thermal head according to claim 3, wherein said heat storage layer is made of a glass having a low melting point.

5. A thermal head according to claim 3, wherein said heat storage layer is made of a heat resistant synthetic resin.

6. A thermal head according to claim 5, wherein said heat resistant synthetic resin includes ceramic fillers and/or metal powders for adjusting a thermal conductance and thermal expansion of the heat storage layer.

7. A thermal head according to claim 3, wherein said heat control section further comprises a heat conduction member for dissipating a heat stored in the heat storage layer, said heat conduction member being provided on a surface of the heat storage layer remote from the protection layer.

8. A thermal head according to claim 7, wherein said heat conduction member is made of an alumina based ceramic coating agent.

9. A thermal head according to claim 7, wherein said heat conduction member is made of a metal.

10. A thermal head according to claim 9, wherein said heat conduction head is formed by a metal rod.

11. A thermal head according to claim 3, wherein said thermal head further comprises a supporting means for supporting an assembly of said reinforcing layer, protection layer, heat generating section and heat control section, said supporting means being provided on the second surface of said protection layer.

12. A thermal head according to claim 11, wherein said supporting means includes a supporting member made of a heat resistant synthetic resin.

13. A thermal head according to claim 12, wherein said supporting means includes a metal substrate plate and said IC is provided in a recess formed in said metal substrate plate.

14. A thermal head according to claim 11, wherein said supporting means includes a metal plate.

15. A thermal head according to claim 11, wherein said driving circuit is formed by an IC which is provided on the second surface of the protection layer.

16. A thermal head according to claim 15, wherein said supporting means includes a supporting member made of a synthetic resin and said IC is embedded in said supporting member.

17. A thermal head according to claim 15, wherein said IC is provided in a recess formed in the second surface of the reinforcing layer.

18. A thermal head according to claim 1, wherein said reinforcing layer is made of a glass.

19. A thermal head according to claim 18, wherein said glass is a borosilicate glass.

20. A thermal head according to claim 19, wherein said protection layer is made of a material selected from the group consisting of SiC compounds, SiB compounds, SiN compounds, AIN compounds and BN compounds.

21. A thermal head according to claim 1, wherein said reinforcing layer has a flat top surface.

22. A method of manufacturing a thermal head comprising the steps of:

forming a groove in a surface of a preliminary substrate;

forming a protection layer on an inner surface of said groove as well as on said surface of the preliminary substrate, a portion of said protection layer provided on the inner surface of the groove constituting a printing surface and said protection layer being made of a material different from said preliminary substrate;

forming a heat generating section on said protection layer at least at said groove, said heat generating section including heat generating resistors and electrodes connected to the resistors;

forming a heat control section at least on said heat generating section, said heat control section including at least a heat storage layer; and forming a reinforcing layer by removing a part of said preliminary substrate such that at least a part of said printing surface of the protection layer is exposed.

23. A method according to claim 22, wherein said step of forming the reinforcing layer includes a step of covering an assembly with an anti-etching layer, and a step of etching a part of the preliminary substrate.

24. A method according to claim 22, wherein said step of forming the reinforcing layer includes a step of covering the assembly with an anti-etching layer, a step of mechanically polishing said preliminary substrate to such a level that said printing surface is still covered with a thin film of a material of said preliminary substrate, and a step of wet-etching the preliminary substrate until said printing surface is exposed.

25. A method according to claim 22, wherein said step of forming the reinforcing layer includes a step of covering the assembly with an anti-etching layer, a step of mechanically polishing said preliminary substrate to such a level that said printing surface is still covered with a thin film of a material of said preliminary substrate, and a step of chemical-mechanical-polishing the preliminary substrate until said printing surface is exposed.

26. A method according to claim 22, wherein said step of forming the heat generating section including a step of forming heat generating resistors on the protection layer, and a step of forming a common electrode connected to one ends of said heat generating resistors and separate electrodes connected to the other ends of the respective heat generating resistors.

27. A method according to claim 22, wherein said step of forming the heat control section includes a step of forming a heat storage layer at least on a side of said heat generating section remote from said protection layer.

28. A method according to claim 27, wherein said step of forming the heat control section further includes a step of forming a heat conduction member such that at least said heat storage layer is covered with the heat conduction member.

29. A method according to claim 28, wherein said step of forming the heat conduction member includes a step of applying an alumina based ceramic coating agent at least on the surface of the heat storage layer.

30. A method according to claim 28, wherein said step of forming the heat conduction member includes a step of securing a metal rod at least to the surface of the heat storage layer by means of a heat resistant resin.

31. A method according to claim 28, wherein said step of forming the heat conduction member includes a step of depositing a thin metal film at least on the surface of the heat storage layer, and a step of electroplating a metal layer on the thin metal film.

* * * * *